US009790061B2

(12) United States Patent
Schneider et al.

(10) Patent No.: US 9,790,061 B2
(45) Date of Patent: Oct. 17, 2017

(54) CRANE CONTROLLER WITH DIVISION OF A KINEMATICALLY CONSTRAINED QUANTITY OF THE HOISTING GEAR

(71) Applicant: Liebherr-Werk Nenzing GmbH, Nenzing (AT)

(72) Inventors: Klaus Schneider, Hergatz (DE); Sebastian Kuechler, Boeblingen (DE); Oliver Sawodny, Stuttgart (DE); Johannes Karl Eberharter, Satteins (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 180 days.

(21) Appl. No.: 13/788,828

(22) Filed: Mar. 7, 2013

(65) Prior Publication Data

US 2013/0245815 A1 Sep. 19, 2013

(30) Foreign Application Priority Data

Mar. 9, 2012 (DE) ..... 10 2012 004 802

(51) Int. Cl.

*B66C 13/18* (2006.01)
*B66C 13/06* (2006.01)
*B66D 1/52* (2006.01)
*B66C 13/04* (2006.01)

(52) U.S. Cl.

CPC ..... *B66C 13/18* (2013.01); *B66C 13/04* (2013.01); *B66C 13/063* (2013.01); *B66D 1/525* (2013.01)

(58) Field of Classification Search

CPC ..... B66C 13/063; B66C 13/02; B66C 13/085; B66C 23/52; B66D 1/52

USPC ..... 212/272, 284, 307–310; 254/275, 277

See application file for complete search history.

(56) References Cited

U.S. PATENT DOCUMENTS

| | | | | |
|---|---|---|---|---|
| 3,995,746 | A * | 12/1976 | Usagida | 414/738 |
| 4,121,806 | A * | 10/1978 | Iato et al. | 166/355 |
| 4,180,171 | A * | 12/1979 | Cunningham et al. | 212/273 |
| 4,349,179 | A * | 9/1982 | Barber | 254/270 |
| 4,448,396 | A * | 5/1984 | Delago | 254/340 |
| 4,756,432 | A * | 7/1988 | Kawashima et al. | 212/275 |
| 5,117,992 | A * | 6/1992 | Simkus et al. | 212/275 |
| 5,127,533 | A * | 7/1992 | Virkkunen | 212/275 |
| 5,209,302 | A * | 5/1993 | Robichaux et al. | 166/355 |
| 5,392,935 | A * | 2/1995 | Kazama et al. | 212/278 |
| 5,443,566 | A * | 8/1995 | Rushmer et al. | 212/275 |
| 5,490,601 | A * | 2/1996 | Heissat et al. | 212/275 |
| 5,510,988 | A * | 4/1996 | Majeed et al. | 701/37 |
| 5,550,733 | A * | 8/1996 | Yun et al. | 700/69 |
| 5,732,835 | A * | 3/1998 | Morita et al. | 212/278 |
| 5,785,191 | A * | 7/1998 | Feddema et al. | 212/275 |
| 5,823,369 | A * | 10/1998 | Kuromoto | 212/273 |
| 5,967,347 | A * | 10/1999 | Miyata et al. | 212/286 |
| 6,082,947 | A * | 7/2000 | Adamson | 414/137.7 |
| 6,216,789 | B1 * | 4/2001 | Lorsignol et al. | 166/355 |
| 6,234,332 | B1 * | 5/2001 | Monzen et al. | 212/275 |
| 6,439,407 | B1 * | 8/2002 | Jacoff et al. | 212/274 |
| 6,588,610 | B2 * | 7/2003 | Ong et al. | 212/275 |
| 6,601,718 | B2 * | 8/2003 | Sawodny et al. | 212/270 |
| 6,631,300 | B1 * | 10/2003 | Nayfeh et al. | 700/55 |
| 6,826,452 | B1 * | 11/2004 | Holland et al. | 700/245 |
| 7,367,464 | B1 * | 5/2008 | Agostini et al. | 212/308 |
| 7,599,762 | B2 * | 10/2009 | Discenzo et al. | 701/1 |
| 7,648,036 | B2 * | 1/2010 | Recktenwald et al. | 212/273 |
| 7,731,157 | B2 * | 6/2010 | Davidson | 254/277 |
| 7,793,763 | B2 * | 9/2010 | Zhu et al. | 187/411 |
| 7,798,471 | B2 * | 9/2010 | Christopher | 254/277 |
| 7,831,333 | B2 * | 11/2010 | Sawodny et al. | 700/213 |
| 8,014,982 | B2 * | 9/2011 | Kang et al. | 703/2 |
| 8,195,368 | B1 * | 6/2012 | Leban et al. | 701/50 |
| 8,235,231 | B2 * | 8/2012 | Schneider et al. | 212/308 |
| 8,265,811 | B2 * | 9/2012 | Kyllingstad | 701/21 |
| 8,297,597 | B2 * | 10/2012 | Dalsmo et al. | 254/277 |
| 8,640,340 | B2 * | 2/2014 | Foo et al. | 29/897.33 |
| 8,651,301 | B2 * | 2/2014 | Kiova et al. | 212/284 |
| 2003/0107029 | A1 * | 6/2003 | Hanson et al. | 254/362 |
| 2004/0164041 | A1 * | 8/2004 | Sawodny et al. | 212/273 |
| 2005/0179021 | A1 * | 8/2005 | Selcer et al. | 254/275 |
| 2005/0242332 | A1 * | 11/2005 | Ueki et al. | 254/277 |
| 2007/0017889 | A1 * | 1/2007 | Schobesberger | 212/308 |
| 2007/0050115 | A1 * | 3/2007 | Discenzo et al. | 701/50 |
| 2008/0053945 | A1 * | 3/2008 | Schneider et al. | 212/276 |
| 2008/0251258 | A1 * | 10/2008 | Bamford | 166/355 |
| 2009/0008351 | A1 * | 1/2009 | Schneider et al. | 212/272 |
| 2009/0232625 | A1 * | 9/2009 | Almeda et al. | 414/139.6 |
| 2010/0012611 | A1 * | 1/2010 | Sawodny et al. | 212/273 |
| 2010/0038091 | A1 * | 2/2010 | Sack | 166/345 |
| 2010/0230370 | A1 * | 9/2010 | Schneider et al. | 212/276 |
| 2011/0006024 | A1 * | 1/2011 | Schneider et al. | 212/272 |
| 2011/0006025 | A1 * | 1/2011 | Schneider et al. | 212/273 |
| 2012/0084052 | A1 * | 4/2012 | Choi | 702/158 |
| 2013/0032561 | A1 * | 2/2013 | Singhose et al. | 212/273 |
| 2013/0236272 | A1 * | 9/2013 | Gassner et al. | 414/139.6 |
| 2013/0245815 | A1 * | 9/2013 | Schneider et al. | 700/228 |
| 2013/0245816 | A1 * | 9/2013 | Langer et al. | 700/228 |
| 2013/0245817 | A1 * | 9/2013 | Schneider et al. | 700/228 |
| 2014/0263142 | A1 * | 9/2014 | Billiot et al. | 212/272 |

FOREIGN PATENT DOCUMENTS

| | | | |
|---|---|---|---|
| DE | 3643114 | A1 | 8/1987 |
| DE | 19645812 | C1 | 2/1998 |
| DE | 102008024513 | A1 | 11/2009 |
| DE | 102009032269 | A1 | 1/2011 |
| EP | 0176832 | A1 | 4/1986 |
| WO | 0227684 | A1 | 4/2002 |

OTHER PUBLICATIONS

Langer, K. et al., "Crane Controller with Cable Force Mode", U.S. Appl. No. 13/788,851, 40 pages.

Schneider, K. et al., "Crane Controller with Drive Constraint", U.S. Appl. No. 13/788,856, 42 pages.

* cited by examiner

*Primary Examiner* — Emmanuel M Marcelo
*Assistant Examiner* — Michael Gallion
(74) *Attorney, Agent, or Firm* — McCoy Russell LLP

(57) ABSTRACT

The present disclosure relates to a crane controller for a crane which includes a hoisting gear for lifting a load hanging on a cable, with an active heave compensation which by actuating the hoisting gear at least partly compensates the movement of the cable suspension point and/or of a load deposition point due to the heave, and an operator control which actuates the hoisting gear with reference to specifications of the operator, wherein the division of at least one kinematically constrained quantity of the hoisting gear is adjustable between heave compensation and operator control.

13 Claims, 7 Drawing Sheets

CRANE CONTROLLER WITH DIVISION OF A KINEMATICALLY CONSTRAINED QUANTITY OF THE HOISTING GEAR

CROSS REFERENCE TO RELATED APPLICATION

This application claims priority to German Patent Application No. 10 2012 004 802.5, entitled "Crane Controller with Division of a Kinematically Constrained Quantity of the Hoisting Gear," filed Mar. 9, 2012, which is hereby incorporated by reference in its entirety for all purposes.

TECHNICAL FIELD

The present disclosure relates to a crane controller for a crane which includes a hoisting gear for lifting a load hanging on a cable. According to the present disclosure, the crane controller includes an active heave compensation which by actuating the hoisting gear at least partly compensates the movement of the cable suspension point and/or a load deposition point due to the heave. The crane controller furthermore includes an operator control which actuates the hoisting gear with reference to specifications of the operator.

BACKGROUND AND SUMMARY

Such crane controller is known for example from DE 10 2008 024513 A1. There is provided a prediction device which predicts a future movement of the cable suspension point with reference to the determined current heave movement and a model of the heave movement, wherein the path controller takes account of the predicted movement when actuating the hoisting gear.

The known crane controller however is not sufficiently flexible for some requirements. In addition, problems may arise in the case of a failure of the heave compensation.

Therefore, it is the object of the present disclosure to provide an improved crane controller with an active heave compensation and an operator control.

According to the present disclosure, this object is solved in a first aspect according to claim 1 and in a second aspect according to claim 4.

In a first aspect, the present disclosure shows a crane controller for a crane which includes a hoisting gear for lifting a load hanging on a cable. There is provided an active heave compensation which by actuating the hoisting gear at least partly compensates a movement of the cable suspension point and/or a load deposition point due to the heave. Furthermore an operator control is provided, which actuates the hoisting gear with reference to specifications of the operator. According to the present disclosure, a division of at least one kinematically constrained quantity of the hoisting gear is adjustable between heave compensation and operator control. In this way, the crane operator himself can split up the at least one kinematically constrained quantity of the hoisting gear and thereby determine which part of it is available for the compensation of the heave and which part of it is available for the operator control.

The at least one kinematically constrained quantity of the hoisting gear for example can be the maximum available power and/or maximum available velocity and/or maximum available acceleration of the hoisting gear.

The division of the at least one kinematically constrained quantity of the hoisting gear therefore can comprise a division of the maximum available power and/or maximum available velocity and/or maximum available acceleration of the hoisting gear.

Advantageously, the division of the at least one kinematically constrained quantity is effected by at least one weighting factor, by which the maximum available power and/or velocity and/or acceleration of the hoisting gear is split up between the heave compensation and the operator control. In particular, the maximum available velocity and/or the maximum available acceleration of the hoisting gear can be split up by the crane operator between heave compensation and operator control.

Advantageously, the division is steplessly adjustable at least in a partial region. It thus becomes possible for the crane operator to sensitively split up the at least one kinematically constrained quantity of the hoisting gear.

According to the present disclosure, it can furthermore be possible to switch off the heave compensation by assigning the entire at least one kinematically constrained quantity of the hoisting gear to the operator control. It thus becomes possible to at the same time completely switch off the active heave compensation via the adjustment of the division.

Advantageously, a stepless adjustment of the division of the at least one kinematically constrained quantity of the hoisting gear is possible proceeding from and/or towards an operator control completely switched off. This enables a steady transition between a pure operator control and an active heave compensation.

In a second aspect, the present disclosure comprises a crane controller for a crane which includes a hoisting gear for lifting a load hanging on a cable. The crane controller comprises an active heave compensation which by actuating the hoisting gear at least partly compensates the movement of the cable suspension point and/or a load deposition point due to the heave. Furthermore an operator control is provided, which actuates the hoisting gear with reference to specifications of the operator. According to the present disclosure, the controller includes two separate path planning modules via which trajectories for the heave compensation and for the operator control are calculated separate from each other. In the case of a failure of the heave compensation, the crane thereby can still be actuated via the operator control, without a separate control unit having to be used for this purpose and without this resulting in a different operating behavior. Advantageously, in the two separate path planning modules desired trajectories of the position and/or velocity and/or acceleration of the hoisting gear each are calculated.

Furthermore advantageously, the trajectories specified by the two separate path planning modules are added up and used as setpoint values for the control and/or regulation of the hoisting gear.

Furthermore, it can be provided that the control of the hoisting gear feeds back measured values to the position and/or velocity of the hoisting winch and thus compares the setpoint values with actual values. Furthermore, the actuation of the hoisting gear can take account of the dynamics of the drive of the hoisting winch. In particular, a corresponding pilot control can be provided for this purpose. Advantageously, the same is based on the inversion of a physical model of the dynamics of the drive of the hoisting winch.

Advantageously, the two separate path planning modules each separately take account of at least one constraint of the drive and thereby generate target trajectories which can actually be approached by the hoisting gear.

Advantageously, the crane controller splits up at least one kinematically constrained quantity between heave compensation and operator control. In particular, the maximum available power and/or the maximum available velocity and/or the maximum available acceleration of the hoisting gear is split up between the heave compensation and the operator control.

Advantageously, the trajectories in the two separate path planning modules then are calculated taking into account the respectively assigned at least one kinematically constrained quantity, in particular the maximum available power and/or velocity and/or the maximum available acceleration which is accounted for the heave compensation and the operator control, respectively.

By this division of the at least one kinematically constrained quantity, the control variable constraint possibly is not utilized completely. The division of the at least one kinematically constrained quantity however provides for using two completely separate path planning modules, which each independently take account of the drive constraint.

The first and the second aspect according to the present disclosure each are claimed separately and can be implemented independently. Particularly advantageously, however, the two aspects according to the present disclosure are combined with each other.

In particular, the use of two separate path planning modules according to the second aspect of the present disclosure provides for a particularly easy adjustability of the division of the at least one kinematically constrained quantity. In particular, it can be specified by the crane operator how much of the at least one kinematically constrained quantity is available for the operator control and the heave compensation, with this division then being taken into account as constraint by the two path planning modules when calculating the target trajectories for actuating the hoisting gear.

In a crane controller according to one of the above-described aspects, the heave compensation according to the present disclosure can include an optimization function which calculates a trajectory with reference to a predicted movement of the cable suspension point and/or a load deposition point and taking into account the power available for the heave compensation. In particular, there is calculated a trajectory for actuating the hoisting gear, which taking into account the power available for the heave compensation compensates the predicted movement of the cable suspension point and/or a load deposition point as well as possible. In particular, the trajectory can minimize the residual movement of the load due to the movement of the cable suspension point and/or a differential movement between load and load deposition point, which occurs due to the heave.

The crane controller according to the present disclosure advantageously comprises a prediction device which predicts a future movement of the cable suspension point and/or a load deposition point with reference to the determined current heave movement and a model of the heave movement, wherein a measuring device is provided, which determines the current heave movement with reference to sensor data. In particular, the prediction device predicts the future movement of the cable suspension point and/or a load deposition point in vertical direction. The movement in vertical direction on the other hand can be neglected.

The prediction device and/or the measuring device can be configured such as is described in DE 10 2008 024513 A1.

The operator control furthermore can calculate a trajectory with reference to specifications of the operator and taking into account the at least one kinematically constrained quantity available for the operator control. Advantageously, the operator control thus also takes account of the at least one kinematically constrained quantity maximally available for the operator control and thus calculates a trajectory for actuating the hoisting gear from specifications of the operator.

By taking into account the respectively available at least one kinematically constrained quantity, it is ensured that the hoisting gear actually can follow the specified trajectories. Advantageously, the determination of the trajectories each is effected in the above-described path planning modules.

Advantageously, the crane controller includes at least one control element via which the crane operator can adjust the division of the available at least one kinematically constrained quantity and in particular can specify the weighting factor.

In the crane controller according to the present disclosure, the division of the available at least one kinematically constrained quantity advantageously can be varied during the lift. The crane operator thereby is able for example to provide more power for the operator control, when faster lifting is desired. On the other hand, more power can be supplied to the heave compensation when the crane operator has the feeling that the heave is not compensated sufficiently. For example, the crane operator thus is able to flexible react to changes of the weather and the heave.

Advantageously, the change of the division of the available at least one kinematically constrained quantity is effected as described above by varying the weighting factor.

Advantageously, the crane controller according to the present disclosure includes a calculation function which calculates the currently available at least one kinematically constrained quantity. In particular, the maximum available power and/or velocity and/or acceleration of the hoisting gear can be calculated. Since the maximum available power and the maximum available velocity and/or acceleration of the hoisting gear can change during the lift, the same thus can be adapted to the current circumstances of the lift via the calculation function.

Advantageously, the calculation function takes account of the length of the unwound cable and/or the cable force and/or the power available for driving the hoisting gear. For example, depending on the length of the unwound cable the maximum available velocity and/or acceleration of the hoisting gear can be different, since especially during lifts with very long cables the weight of the unwound cable exerts a load on the hoisting gear. In addition, the maximum available velocity and/or acceleration of the hoisting gear can fluctuate depending on the mass of the lifted load. Furthermore, in particular when a hybrid drive with an accumulator is used, the power available for driving the hoisting gear can fluctuate depending on the accumulator condition. Advantageously, this will also be taken into account.

According to the present disclosure, the currently available at least one kinematically constrained quantity each advantageously is split up between heave compensation and operator control according to the specification of the crane operator, in particular with reference to the weighting factor specified by the crane operator.

Advantageously, the optimization function of the heave compensation initially can include a change in the division of the available at least one kinematically constrained quantity and/or a change of the available at least one kinematically constrained quantity during a lift only at the end of the prediction horizon. This provides for a stable optimization function over the entire prediction horizon. Advantageously, with progressing time the changed available at least one kinematically constrained quantity will then be pushed through to the beginning of the prediction horizon.

Advantageously, the optimization function of the heave compensation according to the present disclosure determines a target trajectory which is included in the control and/or regulation of the hoisting gear. In particular, the target trajectory is meant to specify a target movement of the hoisting gear. The optimization can be effected via a discretization.

According to the present disclosure, the optimization can be effected at each time step on the basis of an updated prediction of the movement of the load lifting point.

According to the present disclosure, the first value of the target trajectory each can be used for controlling the hoisting gear. When an updated target trajectory then is available, only the first value thereof will in turn be used for the control.

According to the present disclosure, the optimization function can operate with a greater scan time than the control. This provides for choosing greater scan times for the calculation-intensive optimization function, for the less calculation-intensive control, on the other hand, a greater accuracy due to lower scan times.

Furthermore, it can be provided that the optimization function makes use of an emergency trajectory planning when no valid solution can be found. In this way, a proper operation also is ensured when a valid solution cannot be found.

Advantageously, the operator control calculates the velocity of the hoisting winch desired by the operator with reference to a signal specified by an operator through an input device. In particular, a hand lever can be provided.

The desired velocity can be calculated for the operator control as the part of the maximum available velocity specified by the position of the input device.

Advantageously, the target trajectory is generated by integration of the maximum admissible positive jerk, until the maximum acceleration is achieved. It thereby is ensured that the hoisting gear is not overloaded by the operator control. Advantageously, the maximum acceleration corresponds to the part of the maximum available acceleration of the hoisting gear which is assigned to the operator control.

Furthermore advantageously, the velocity thereupon is increased by integration of the maximum acceleration, until the desired velocity can be achieved by adding the maximum negative jerk.

It thereby is ensured that on achieving the target velocity, the acceleration again has decreased to zero, so that unnecessary loads by an acceleration jump on reaching the target velocity are avoided.

The present disclosure furthermore comprises a crane with a crane controller as it has been described above.

In particular, the crane can be arranged on a pontoon. In particular, the crane can be a deck crane. Alternatively, it can also be an offshore crane, a harbor crane or a cable excavator.

The present disclosure furthermore comprises a pontoon with a crane according to the present disclosure, in particular a ship with a crane according to the present disclosure.

Furthermore, the present disclosure comprises the use of a crane according to the present disclosure and a crane controller according to the present disclosure for lifting and/or lowering a load located in water and/or the use of a crane according to the present disclosure and a crane controller according to the present disclosure for lifting and/or lowering a load from and/or to a load deposition position located in water, for example on a ship. In particular, the present disclosure comprises the use of the crane according to the present disclosure and the crane controller according to the present disclosure for deep-sea lifts and/or for loading and/or unloading ships.

The present disclosure furthermore comprises a method for controlling a crane which includes a hoisting gear for lifting a load hanging on a cable. Advantageously, a heave compensation at least partly compensates the movement of the cable suspension point and/or load deposition point due to the heave by an automatic actuation of the hoisting gear. Furthermore, the hoisting gear is actuated with reference to specifications of the operator via an operator control. In accordance with the present disclosure it is provided according to a first aspect that at least one kinematically constrained quantity of the hoisting gear is variably split up between the heave compensation and the operator control. According to a second aspect it is provided that trajectories for the heave compensation and for the operator control are calculated separate from each other. The method according to the present disclosure hence provides the same advantages which have already been described above with regard to the crane controller. Again, the two aspects may be combined with each other.

The method is carried out such as has already been set forth in detail in accordance with the present disclosure with regard to the crane controller and its function. Furthermore advantageously, the method according to the present disclosure serves the use which likewise has already been set forth above.

In particular, the method according to the present disclosure can be carried out by means of a crane controller as it has been set forth above and/or by means of a crane as it has been set forth above.

The present disclosure furthermore comprises software with code for carrying out a method according to the present disclosure. In particular, the software can be stored on a machine-readable data carrier. Advantageously, a crane controller according to the present disclosure can be implemented by installing the software according to the present disclosure on a crane controller.

The present disclosure will now be explained in detail with reference to an exemplary embodiment and drawings.

DETAILED DESCRIPTION

Figure 1:
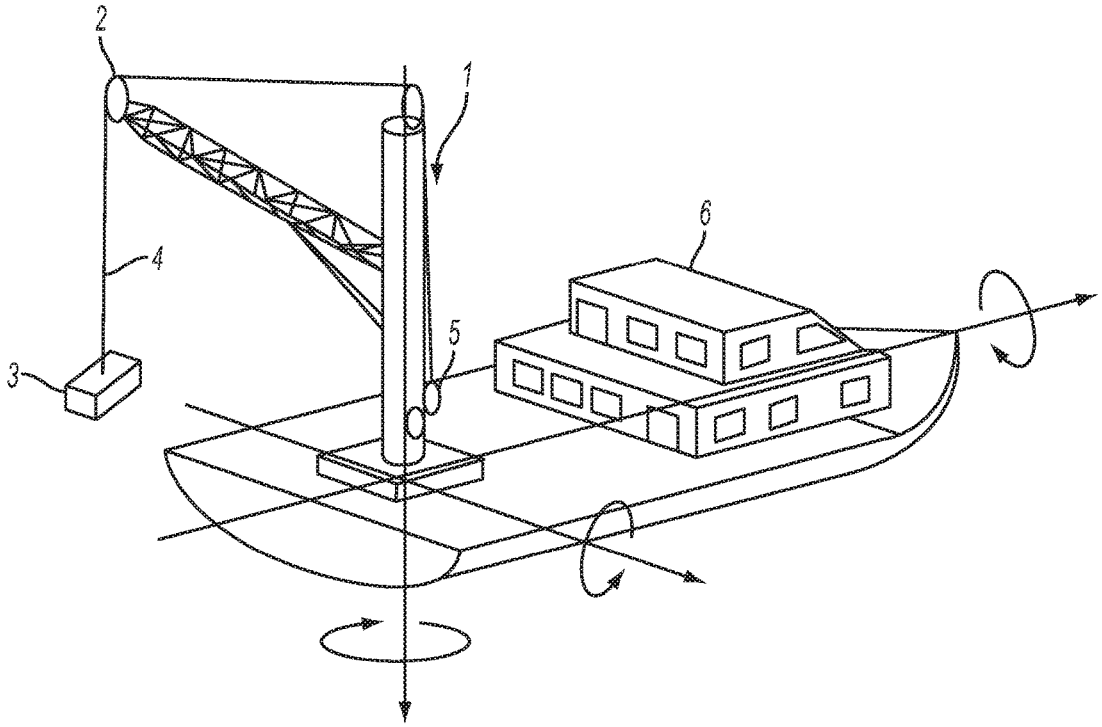
FIG. 1 shows a crane according to the present disclosure arranged on a pontoon.

FIG. 1 shows an exemplary embodiment of a crane 1 with a crane controller according to the present disclosure for actuating the hoisting gear 5. The hoisting gear 5 includes a hoisting winch which moves the cable 4. The cable 4 is guided over a cable suspension point 2, in the exemplary embodiment a deflection pulley at the end of the crane boom, at the crane. By moving the cable 4, a load 3 hanging on the cable can be lifted or lowered.

There can be provided at least one sensor which measures the position and/or velocity of the hoisting gear and transmits corresponding signals to the crane controller.

Furthermore, at least one sensor can be provided, which measures the cable force and transmits corresponding signals to the crane controller. The sensor can be arranged in the region of the crane body, in particular in a mount of the winch 5 and/or in a mount of the cable pulley 2.

In the exemplary embodiment, the crane 1 is arranged on a pontoon 6, here a ship. As is likewise shown in FIG. 1, the pontoon 6 moves about its six degrees of freedom due to the heave, the heaving including heaving motion. The crane 1 arranged on the pontoon 6 as well as the cable suspension point 2 also are moved thereby.

The crane controller may be a microcomputer including: a microprocessor unit, input/output ports, read-only memory, random access memory, keep alive memory, and a data bus. As noted above, software with code for carrying out the methods according to the present disclosure may be stored on a machine-readable data carrier in the controller. Advantageously, a crane controller according to the present disclosure can be implemented by installing the software according to the present disclosure on a crane controller. The crane controller may receive various signals from sensors coupled to the crane and/or pontoon. In one example, the software may include various programs (including control and estimation routines, operating in real-time), such as heave compensation, as described herein. The specific routines described herein may represent one or more of any number of processing strategies such as event-driven, interrupt-driven, multi-tasking, multi-threading, and the like. Thus, the described methods may represent code to be programmed into the computer readable storage medium in the crane control system.

In one example, the crane controller according to the present disclosure can include an active heave compensation which by actuating the hoisting gear at least partly compensates the movement of the cable suspension point 2 due to the heave. In particular, the vertical movement of the cable suspension point due to the heave is at least partly compensated.

The heave compensation can comprise a measuring device which determines a current heave movement from sensor data. The measuring device can comprise sensors which are arranged at the crane foundation. In particular, this can be gyroscopes and/or tilt angle sensors. Particularly, three gyroscopes and three tilt angle sensors are provided.

Furthermore a prediction device can be provided, which predicts a future movement of the cable suspension point 2 with reference to the determined heave movement and a model of the heave movement. In particular, the prediction device solely predicts the vertical movement of the cable suspension point. In connection with the measuring and/or prediction device, a movement of the ship at the point of the sensors of the measuring device possibly can be converted into a movement of the cable suspension point.

The prediction device and the measuring device advantageously are configured such as is described in more detail in DE 10 2008 024513 A1.

Alternatively, the crane according to the present disclosure also might be a crane which is used for lifting and/or lowering a load from or to a load deposition point arranged on a pontoon, which therefore moves with the heave. In this case, the prediction device must predict the future movement of the load deposition point. This can be effected analogous to the procedure described above, wherein the sensors of the measuring device are arranged on the pontoon of the load deposition point. The crane for example can be a harbor crane, an offshore crane or a cable excavator.

In the exemplary embodiment, the hoisting winch of the hoisting gear 5 is driven hydraulically. In particular, a hydraulic circuit of hydraulic pump and hydraulic motor is provided, via which the hoisting winch is driven. In one example, a hydraulic accumulator can be provided, via which energy is stored on lowering the load, so that this energy is available when lifting the load.

Alternatively, an electric drive might be used. The same might also be connected with an energy accumulator.

In the following, an exemplary embodiment of the present disclosure will now be shown, in which a multitude of aspects of the present disclosure are jointly realized. The individual aspects can, however, also each be used separately for developing the embodiment of the present disclosure as described in the general part of the present application.

1 Planning of Reference Trajectories

For implementing the required predictive behavior of the active heave compensation, a sequential control comprising a pilot control and a feedback in the form of a structure of two degrees of freedom is employed. The pilot control is calculated by a differential parameterization and requires reference trajectories steadily differentiable two times.

For planning it is decisive that the drive can follow the specified trajectories. Thus, constraints of the hoisting gear are also taken into account. Starting point for the consideration are the vertical position and/or velocity of the cable suspension point $\tilde{z}_a^h$ and $\dot{\tilde{z}}_a^h$, which are predicted e.g. by the algorithm described in DE 10 2008 024 513 over a fixed time horizon. In addition, the hand lever signal of the crane operator, by which he moves the load in the inertial coordinate system, also is included in the trajectory planning.

For safety reasons it is necessary that the winch also can still be moved via the hand lever signal in the case of a failure of the active heave compensation. With the used concept for trajectory planning, a separation between the planning of the reference trajectories for the compensation movement and those as a result of a hand lever signal therefore is effected, as is shown in FIG. 1.

In the Figure, $y_a^*$, $\dot{y}_a^*$ and $\ddot{y}_a^*$ designate the position, velocity and acceleration planned for the compensation, and $y_l^*$, $\dot{y}_l^*$ and $\ddot{y}_l^*$ the position, velocity and acceleration for the superimposed unwinding or winding of the cable as planned on the basis of the hand lever signal. In the further course of the execution, planned reference trajectories for the movement of the hoisting winch always are designated with $y^*$, $\dot{y}^*$ and $\ddot{y}^*$, respectively, since they serve as reference for the system output of the drive dynamics.

Due to the separate trajectory planning it is possible to use the same trajectory planning and the same sequential controller with the heave compensation switched off or in the case of a complete failure of the heave compensation (e.g. due to failure of the IMU) for the hand lever control in manual operation and thereby generate an identical operating behavior with the heave compensation switched on.

In order not to violate the given constraints in velocity $v_{max}$ and acceleration $a_{max}$ despite the completely independent planning, $v_{max}$ and $a_{max}$ are split up by a weighting factor $0 \leq k_l \leq 1$ (cf. FIG. 1). The same is specified by the crane operator and hence provides for individually splitting up the power which is available for the compensation and/or for moving the load. Thus, the maximum velocity and acceleration of the compensation movement are $(1-k_l)v_{max}$ and $(1-k_l)a_{max}$ and the trajectories for the superimposed unwinding and winding of the cable are $k_l v_{max}$ and $k_l a_{max}$.

A change of $k_l$ can be performed during operation. Since the maximum possible traveling speed and acceleration are dependent on the total mass of cable and load, $v_{max}$ and $a_{max}$ also can change in operation. Therefore, the respectively applicable values likewise are handed over to the trajectory planning.

By splitting up the power, the control variable constraints possibly are not utilized completely, but the crane operator can easily and intuitively adjust the influence of the active heave compensation.

A weighting of $k_l=1$ is equal to switching off the active heave compensation, whereby a smooth transition between a compensation switched on and switched off becomes possible.

The first part of the chapter initially explains the generation of the reference trajectories $y_a^*$, $\dot{y}_a^*$ and $\ddot{y}_a^*$ for compensating the vertical movement of the cable suspension point. The essential aspect here is that with the planned trajectories the vertical movement is compensated as far as is possible due to the given constraints set by $k_l$.

Therefore, by the vertical positions and velocities of the cable suspension point $\tilde{z}_a^h=[\tilde{z}_a^h(t_k+T_{p,l}) \ldots \tilde{z}_a^h(t_k+T_{p,K_p})]^T$ and $\dot{z}_a^h=[\dot{z}_a^h(t_k+T_{p,l}) \ldots \dot{z}_a^h(t_k+T_{p,K_p})]^T$ predicted over a complete time horizon, an optimal control problem therefore is formulated, which is solved cyclically, wherein $K_p$ designates the number of the predicted time steps. The associated numerical solution and implementation will be discussed subsequently.

The second part of the chapter deals with the planning of the trajectories $y_l^*$, $\dot{y}_l^*$ and $\ddot{y}_l^*$ for traveling the load. The same are generated directly from the hand lever signal of the crane operator $w_{hh}$. The calculation is effected by an addition of the maximum admissible jerk.

1.1 Reference Trajectories for the Compensation

In the trajectory planning for the compensation movement of the hoisting winch, sufficiently smooth trajectories must be generated from the predicted vertical positions and velocities of the cable suspension point taking into account the valid drive constraints. This task subsequently is regarded as constrained optimization problem, which can be solved online at each time step. Therefore, the approach resembles the draft of a model-predictive control, although in the sense of a model-predictive trajectory generation.

As references or setpoint values for the optimization the vertical positions and velocities of the cable suspension point $\tilde{z}_a^h=[\tilde{z}_a^h(t_k+T_{p,l}) \ldots \tilde{z}_a^h(t_k+T_{p,K_p})]^T$ and $\dot{z}_a^h=[\dot{z}_a^h(t_k+T_{p,l}) \ldots \dot{z}_a^h(t_k+T_{p,K_p})]^T$ are used, which are predicted at the time $t_k$ over a complete time horizon with $K_p$ time steps and are calculated with the corresponding prediction time, e.g. by the algorithm described in DE 10 2008 024 513.

Considering the constraints valid by $k_l$, $v_{max}$ and $a_{max}$ an optimum time sequence thereupon can be determined for the compensation movement.

However, analogous to the model-predictive control only the first value of the trajectory calculated thereby is used for the subsequent control. In the next time step, the optimization is repeated with an updated and therefore more accurate prediction of the vertical position and velocity of the cable suspension point.

The advantage of the model-predictive trajectory generation with successive control as compared to a classical model-predictive control on the one hand consists in that the control part and the related stabilization can be calculated with a higher scan time as compared to the trajectory generation. Therefore, the calculation-intensive optimization can be shifted into a slower task.

In this concept, on the other hand, an emergency function can be realized independent of the control for the case that the optimization does not find a valid solution. It includes a simplified trajectory planning which the control relies upon in such emergency situation and further actuates the winch.

1.1.1 System Model for Planning the Compensation Movement

To satisfy the requirements of the steadiness of the reference trajectories for the compensation movement, its third derivative $\dddot{y}_a^*$ at the earliest can be regarded as jump-capable. However, jumps in the jerk should be avoided in the compensation movement with regard to the winch life, whereby only the fourth derivative $y_a^{(4)*}$ can be regarded as jump-capable.

Figure 2:
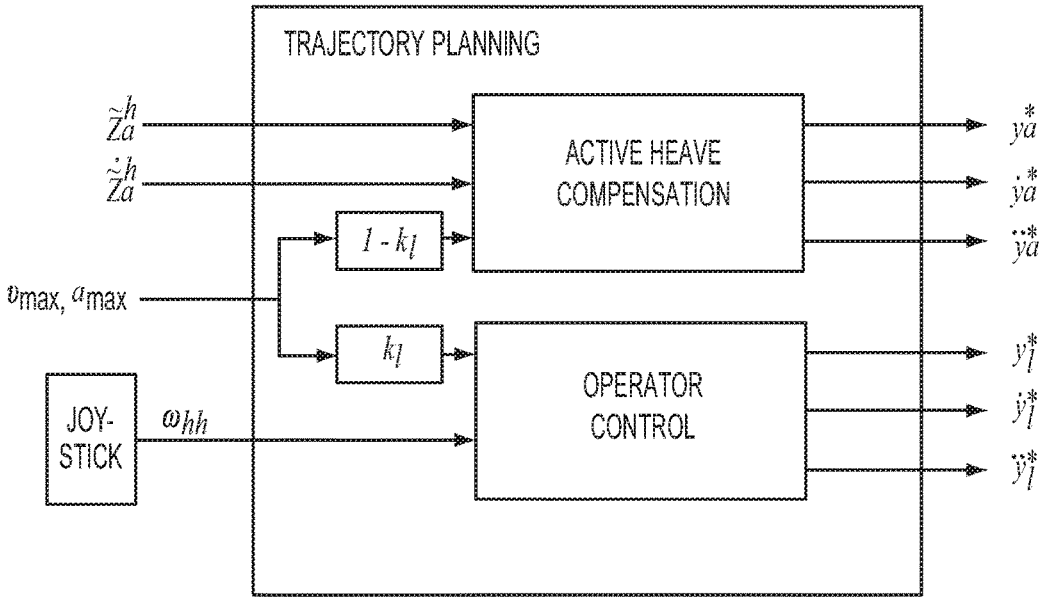
FIG. 2 shows the structure of a separate trajectory planning for the heave compensation and the operator control.

Thus, the jerk $\dddot{y}_a^*$ must at least be planned steady and the trajectory generation for the compensation movement is effected with reference to the fourth order integrator chain illustrated in FIG. 2. In the optimization, the same serves as system model and can be expressed as $$\dot{x}_a = \underbrace{\begin{bmatrix} 0 & 1 & 0 & 0 \\ 0 & 0 & 1 & 0 \\ 0 & 0 & 0 & 1 \\ 0 & 0 & 0 & 0 \end{bmatrix}}_{A_a} x_a + \underbrace{\begin{bmatrix} 0 \\ 0 \\ 0 \\ 1 \end{bmatrix}}_{B_a} u_a,\ x_a(0) = x_{a,0}, \tag{1.1}$$

$$y_a = x_a$$

in the state space. Here, the output $y_a=[y_a^*,\dot{y}_y^*,\ddot{y}_a^*,\dddot{y}_a^*]^T$ includes the planned trajectories for the compensation movement. For formulating the optimal control problem and with regard to the future implementation, this time-continuous model initially is discretized on the lattice $$\tau_0<\tau_1<\ldots<\tau_{K_p-1}<\tau_{K_p} \tag{1.2}$$

wherein $K_p$ represents the number of the prediction steps for the prediction of the vertical movement of the cable suspension point. To distinguish the discrete time representation in the trajectory generation from the discrete system time $t_k$, it is designated with $\tau_k = k\Delta\tau$, wherein $k=0, \ldots, K_p$ and $\Delta\tau$ is the discretization interval of the horizon $K_p$ used for the trajectory generation.

Figure 3:
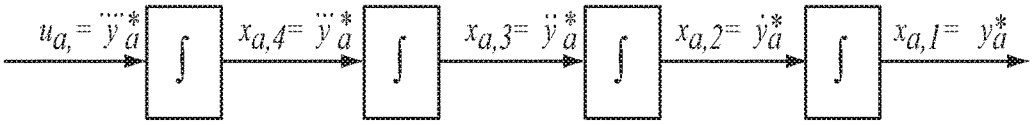
FIG. 3 shows a fourth order integrator chain for planning trajectories with steady jerk.

FIG. 3 illustrates that the chosen lattice is non-equidistant, so that the number of the necessary supporting points on the horizon is reduced. Thus, it is possible to keep the dimension of the optimal control problem to be solved small. The influence of the rougher discretization towards the end of the horizon has no disadvantageous effects on the planned trajectory, since the prediction of the vertical position and velocity is less accurate towards the end of the prediction horizon.

The time-discrete system representation valid for this lattice can be calculated exactly with reference to the analytical solution $$x_a(t) = e^{A_a t} x_a(0) + \int_0^t e^{A_a(t-\tau)} B_a u_a(\tau) d\tau \tag{1.3}$$

For the integrator chain from FIG. 2 it follows to $$x_a(\tau_{k+1}) = \begin{bmatrix} 1 & \Delta\tau_k & \frac{\Delta\tau_k^2}{2} & \frac{\Delta\tau_k^3}{6} \\ 0 & 1 & \Delta\tau_k & \frac{\Delta\tau_k^2}{2} \\ 0 & 0 & 1 & \Delta\tau_k \\ 0 & 0 & 0 & 1 \end{bmatrix} + \begin{bmatrix} \frac{\Delta\tau^{4k}}{24} \\ \frac{\Delta\tau_k^3}{6} \\ \frac{\Delta\tau_k^2}{2} \\ \Delta\tau_k \end{bmatrix} u_a(\tau_k), \tag{1.4}$$

$$x_a(0) = x_{a,0},$$

$$y_a(\tau_k) = x_a(\tau_k),\ k = 0, \ldots, K_p - 1,$$

wherein $\Delta\tau_k = \tau_{k+1} - \tau_k$ describes the discretization step width valid for the respective time step.

1.1.2 Formulation and Solution of the Optimal Control Problem

By solving the optimal control problem a trajectory will be planned, which as closely as possible follows the predicted vertical movement of the cable suspension point and at the same time satisfies the given constraints.

To satisfy this requirement, the merit function reads as follows:

$$J = \frac{1}{2} \sum_{k=1}^{K_p} \left\{ \begin{matrix} [y_a(\tau_k) - w_a(\tau_k)]^T Q_w(\tau_k) | y_a(\tau_k) - w_a(\tau_k)| + \\ u_a(\tau_{k-1}) r_u u_a(\tau_{k-1}) \end{matrix} \right\} \tag{1.5}$$

wherein $w_a(\tau_k)$ designates the reference valid at the respective time step. Since only the predicted position $\tilde{z}_a^h(t_k+T_{p,k})$ and velocity $\dot{\tilde{z}}_a^h(t_k+T_{p,k})$ of the cable suspension point are available here, the associated acceleration and the jerk are set to zero. The influence of this inconsistent specification, however, can be kept small by a corresponding weighting of the acceleration and jerk deviation. Thus:

$$w_a(\tau_k) = [\tilde{z}_a^h(t_k+T_{p,k}) \dot{\tilde{z}}_a^h(t_k+T_{p,k}) 00]^T, k=1, \ldots, K_p. \tag{1.6}$$

Over the positively semidefinite diagonal matrix $$Q_w(\tau_k) = \mathrm{diag}(q_{w,1}(\tau_k), q_{w,2}(\tau_k), q_{w,3}, q_{w,4}), k=1, \ldots, K_p \tag{1.7}$$

deviations from the reference are weighted in the merit function. The scalar factor ru evaluates the correction effort. While $r_u$, $q_{w,3}$ and $q_{w,4}$ are constant over the entire prediction horizon, $q_{w,1}$ and $q_{w,2}$ are chosen in dependence on the time step $\tau_k$. Reference values at the beginning of the prediction horizon therefore can be weighted more strongly than those at the end. Hence, the accuracy of the vertical movement prediction decreasing with increasing prediction time can be depicted in the merit function. Because of the non-existence of the references for the acceleration and the jerk, the weights $q_{w,3}$ and $q_{w,4}$ only punish deviations from zero, which is why they are chosen smaller than the weights for the position $q_{w,1}(\tau_k)$ and velocity $q_{w,2}(\tau_k)$.

The associated constraints for the optimal control problem follow from the available power of the drive and the currently chosen weighting factor $k_l$ (cf. FIG. 1). Accordingly, it applies for the states of the system model from (1.4):

$$\begin{aligned} &-\delta_a(\tau_k)(1-k_l)v_{max} \le x_{a,2}(\tau_k) \le \delta_a(\tau_k)(1-k_l)v_{max}, \\ &-\delta_a(\tau_k)(1-k_l)a_{max} \le x_{a,3}(\tau_k) \le \delta_a(\tau_k)(1-k_l)a_{max}, \\ &\quad k=1, \ldots, K_p, \\ &-\delta_a(\tau_k)j_{max} \le x_{a,4}(\tau_k) \le \delta_a(\tau_k)j_{max} \end{aligned} \tag{1.8}$$

and for the input:

$$\begin{aligned} &-\delta_a(\tau_k)\frac{d}{dt}j_{max} \le u_a(\tau_k) \le \delta_a(\tau_k)\frac{d}{dt}j_{max}, \\ &k = 0, \ldots, K_p - 1. \end{aligned} \tag{1.9}$$

Here, $\delta_a(\tau_k)$ represents a reduction factor which is chosen such that the respective constraint at the end of the horizon amounts to 95% of that at the beginning of the horizon. For the intermediate time steps, $\delta_a(\tau_k)$ follows from a linear interpolation. The reduction of the constraints along the horizon increases the robustness of the method with respect to the existence of admissible solutions.

While the velocity and acceleration constraints can change in operation, the constraints of the jerk $j_{max}$ and the derivative of the jerk d/dt $j_{max}$ are constant. To increase the useful life of the hoisting winch and the entire crane, they are chosen with regard to a maximum admissible shock load. For the positional state no constraints are applicable.

Since the maximum velocity $v_{max}$ and acceleration $a_{max}$ as well as the weighting factor of the power $k_l$ in operation are determined externally, the velocity and acceleration constraints also are changed necessarily for the optimal control problem. The presented concept takes account of the related time-varying constraints as follows: As soon as a constraint is changed, the updated value first is taken into account only at the end of the prediction horizon for the time step $\tau_{K_p}$. With progressing time, it is then pushed to the beginning of the prediction horizon.

Figure 4:
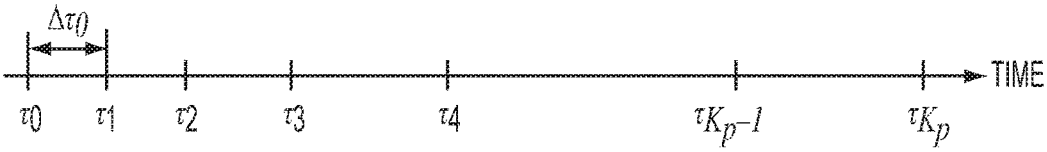
FIG. 4 shows a non-equidistant discretization for trajectory planning, which towards the end of the time horizon uses larger distances than at the beginning of the time horizon.

FIG. 4 illustrates this procedure with reference to the velocity constraint. When reducing a constraint, care should be taken in addition that it fits with its maximum admissible derivative. This means that for example the velocity constraint $(1-k_l)v_{max}$ maximally can be reduced as fast as is allowed by the current acceleration constraint $(1-k_l)a_{max}$. Because the updated constraints are pushed through, there always exists a solution for an initial condition $x_a(\tau_0)$ present in the constraints, which in turn does not violate the updated constraints. However, it will take the complete prediction horizon, until a changed constraint finally influences the planned trajectories at the beginning of the horizon.

Thus, the optimal control problem is completely given by the quadratic merit function (1.5) to be minimized, the system model (1.4) and the inequality constraints from (1.8) and (1.9) in the form of a linear-quadratic optimization problem (QP problem for Quadratic Programming Problem). When the optimization is carried out for the first time, the initial condition is chosen to be $x_a(\tau_0)=[0,0,0,0]^T$. Subsequently, the value $x_a(\tau_1)$ calculated for the time step $\tau_1$ in the last optimization step is used as initial condition.

At each time step, the calculation of the actual solution of the QP problem is effected via a numerical method which is referred to as QP solver.

Due to the calculation effort for the optimization, the scan time for the trajectory planning of the compensation movement is greater than the discretization time of all remaining components of the active heave compensation; thus: $\Delta\tau>\Delta t$.

To ensure that the reference trajectories are available for the control at a faster rate, the simulation of the integrator chain from FIG. 2 takes place outside the optimization with the faster scan time $\Delta t$. As soon as new values are available from the optimization, the states $x_a(\tau_0)$ are used as initial condition for the simulation and the correcting variable at the beginning of the prediction horizon $u_a(\tau_0)$ is written on the integrator chain as constant input.

1.2 Reference Trajectories for Moving the Load

Analogous to the compensation movement, two times steadily differentiable reference trajectories are necessary for the superimposed hand lever control (cf. FIG. 1). As with these movements specifiable by the crane operator, no fast changes in direction normally are to be expected for the winch, the minimum requirement of a steadily planned acceleration $\ddot{y}_l^*$ also was found to be sufficient with respect to the useful life of the winch. Thus, in contrast to the reference trajectories planned for the compensation movement, the third derivative $\dddot{y}_a^*$, which corresponds to the jerk, already can be regarded as jump-capable.

Figure 5:
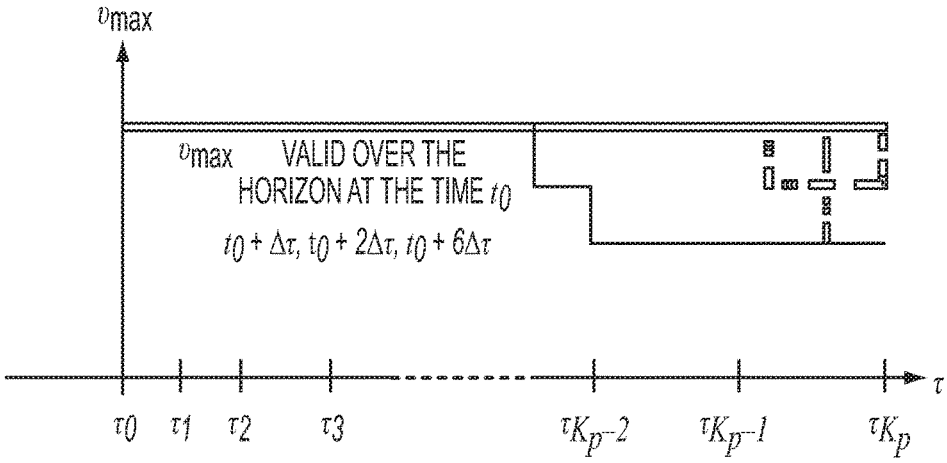
FIG. 5 shows how changing constraints first are taken into account at the end of the time horizon using the example of velocity.

As shown in FIG. 5, it also serves as input of a third order integrator chain. Beside the requirements as to steadiness, the planned trajectories also must satisfy the currently valid velocity and acceleration constraints, which for the hand lever control are found to be $k_l v_{max}$ and $k_l a_{max}$.

Figure 6:
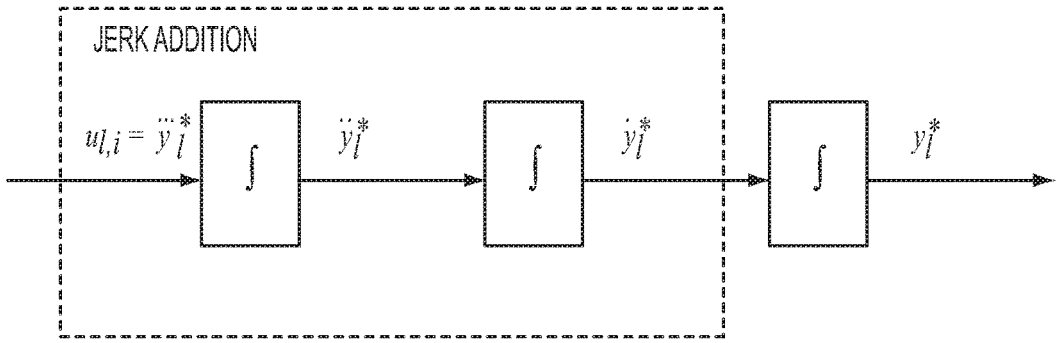
FIG. 6 shows the third order integrator chain used for the trajectory planning of the operator control, which works with reference to a jerk addition.

The hand lever signal of the crane operator $-100 \le w_{hh} \le 100$ is interpreted as relative velocity specification with respect to the currently maximum admissible velocity $k_l v_{max}$. Thus, according to FIG. 6 the target velocity specified by the hand lever is $$v_{hh}^* = k_l v_{max} \frac{w_{hh}}{100}. \tag{1.10}$$

As can be seen, the target velocity currently specified by the hand lever depends on the hand lever position $w_{hh}$, the variable weighting factor $k_l$ and the current maximum admissible winch speed $v_{max}$.

The task of trajectory planning for the hand lever control now can be indicated as follows: From the target velocity specified by the hand lever, a steadily differentiable velocity profile can be generated, so that the acceleration has a steady course. As procedure for this task a so-called jerk addition is recommendable.

The basic idea is that in a first phase the maximum admissible jerk $j_{max}$ acts on the input of the integrator chain, until the maximum admissible acceleration is reached. In the second phase, the speed is increased with constant acceleration; and in the last phase the maximum admissible negative jerk is added such that the desired final speed is achieved.

Figure 7:
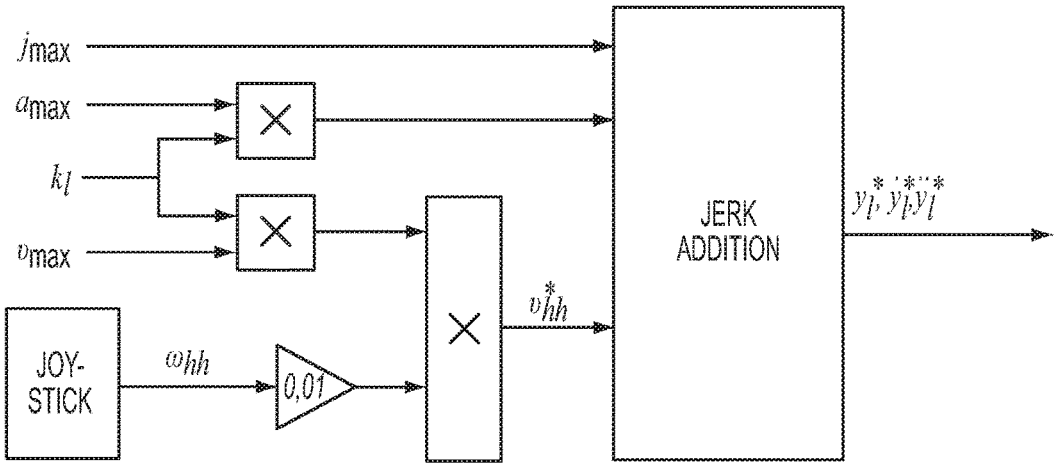
FIG. 7 shows the structure of the path planning of the operator control, which takes account of constraints of the drive.

Therefore, merely the switching times between the individual phases must be determined in the jerk addition. FIG. 7 shows an exemplary course of the jerk for a speed change together with the switching times. $T_{l,0}$ designates the time at which replanning takes place. The times $T_{l,1}$, $T_{l,2}$ and $T_{l,3}$ each refer to the calculated switching times between the individual phases. Their calculation is outlined in the following paragraph.

As soon as a new situation occurs for the hand lever control, replanning of the generated trajectories takes place. A new situation occurs as soon as the target velocity $v_{hh}^*$ or the currently valid maximum acceleration for the hand lever control $k_l a_{max}$ is changed. The target velocity can change due to a new hand lever position $w_{hh}$ or due to a new specification of $k_l$ or $v_{max}$ (cf. FIG. 6). Analogously, a variation of the maximum valid acceleration by $k_l$ or $a_{max}$ is possible.

When replanning the trajectories, that velocity initially is calculated from the currently planned velocity $\dot{y}_l(T_{l,0})$ and the corresponding acceleration $\ddot{y}_l^*(T_{l,0})$ which is obtained with a reduction of the acceleration to zero:

$$\tilde{v} = \dot{y}_l^*(T_{l,0}) + \Delta\tilde{T}_1 \ddot{y}_l^*(T_{l,0}) + \frac{1}{2}\Delta\tilde{T}_1^2 \tilde{u}_{l,1}, \tag{1.11}$$

wherein the minimum necessary time is given by $$\Delta\tilde{T}_1 = -\frac{\ddot{y}_l^*}{\tilde{u}_{l,1}}, \quad \tilde{u}_{l,1} \neq 0 \tag{1.12}$$

and $\tilde{u}_{l,1}$ designates the input of the integrator chain, i.e. the added jerk (cf. FIG. 5): In dependence on the currently planned acceleration $\ddot{y}_l^*(T_{l,0})$ it is found to be $$\tilde{u}_{l,1} = \begin{cases} j_{max}, & \text{for } \ddot{y}_l^* < 0 \\ -j_{max}, & \text{for } \ddot{y}_l^* > 0 \\ 0, & \text{for } \ddot{y}_l^* = 0. \end{cases} \tag{1.13}$$

In dependence on the theoretically calculated velocity and the desired target velocity, the course of the input now can be indicated. If $v_{hh}^*>\tilde{v}$, $\tilde{v}$ does not reach the desired value $v_{hh}^*$ and the acceleration can be increased further. However, if $v_{hh}^*<\tilde{v}$, $\tilde{v}$ is too fast and the acceleration must be reduced immediately.

From these considerations, the following switching sequences of the jerk can be derived for the three phases:

$$u_l = \begin{cases} [\, j_{max} \quad 0 \quad -j_{max} \,], & \text{for } \tilde{v} \le v_{hh}^* \\ [\, -j_{max} \quad 0 \quad j_{max} \,], & \text{for } \tilde{v} > v_{hh}^* \end{cases} \tag{1.14}$$

with $u_l=[u_{l,1},u_{l,2},u_{l,3}]$ and the input signal $u_{l,i}$ added in the respective phase. The duration of a phase is found to be $\Delta T_i=T_{l,i}-T_{l,i-1}$ with i=1, 2, 3. Accordingly, the planned velocity and acceleration at the end of the first phase are:

$$\dot{y}_l^*(T_{l,1}) = \dot{y}_l^*(T_{l,0}) + \Delta T_1 \bar{y}_l^*(T_{l,0}) + \frac{1}{2}\Delta T_1^2 u_{l,1}, \tag{1.15}$$

$$\bar{y}_l^*(T_{l,1}) = \bar{y}_l^*(T_{l,0}) = \Delta T_1 u_{l,1} \tag{1.16}$$

and after the second phase:

$$\dot{y}_l^*(T_{l,2}) = \dot{y}_l^*(T_{l,1}) + \Delta T_2 \ddot{y}_l^*(T_{l,3}) \tag{1.17}$$

$$\ddot{y}_l^*(T_{l,2}) = \ddot{y}_l^*(T_{l,1}). \tag{1.18}$$

wherein $u_{l,2}$ was assumed=0. After the third phase, finally, it follows:

$$\dot{y}_l^*(T_{l,3}) = \dot{y}_l^*(T_{l,2}) + \Delta T_3 \bar{y}_l^*(T_{l,2}) + \frac{1}{2}\Delta T_3^2 u_{l,3}, \tag{1.19}$$

$$\bar{y}_l^*(T_{l,3}) = \bar{y}_l^*(T_{l,2}) + \Delta T_3 u_{l,3}. \tag{1.20}$$

For the exact calculation of the switching times $T_{l,i}$ the acceleration constraint initially is neglected, whereby $\Delta T_2=0$. Due to this simplification, the lengths of the two remaining time intervals can be indicated as follows:

$$\Delta T_1 = \frac{\tilde{a} - \bar{y}_l^*(T_{l,0})}{u_{l,1}}, \tag{1.21}$$

$$\Delta T_3 = \frac{0 - \tilde{a}}{u_{l,3}}, \tag{1.22}$$

wherein $\tilde{a}$ stands for the maximum acceleration achieved. By inserting (1.21) and (1.22) into (1.15), (1.16) and (1.19) a system of equations is obtained, which can be resolved for $\tilde{a}$. Considering $\dot{y}_l^*(T_{l,3})=v_{hh}^*$, the following finally is obtained:

$$\tilde{a} = \pm\sqrt{\frac{u_{l,3}[2\dot{y}_l^*(T_{l,0})u_{l,1} - \bar{y}_l^*(T_{l,0})^2 - 2v_{hh}^* u_{l,1}]}{u_{l,1} - u_{l,3}}}. \tag{1.23}$$

The sign of $\tilde{a}$ follows from the condition that $\Delta T_1$ and $\Delta T_3$ in (1.21) and (1.22) must be positive.

In a second step, $\tilde{a}$ and the maximum admissible acceleration $k_l a_{max}$ result in the actual maximum acceleration:

$$\bar{a} = \ddot{y}_l^*(T_{l,1}) = \ddot{y}_l^*(T_{l,2}) = \min\{k_l a_{max}, \max\{-k_l a_{max}, \bar{a}\}\}. \tag{1.24}$$

With the same, the really occurring time intervals $\Delta T_1$ and $\Delta T_3$ finally can be calculated. They result from (1.21) and (1.22) with $\tilde{a}=\bar{a}$. The yet unknown time interval $\Delta T_2$ now is determined from (1.17) and (1.19) with $\Delta T_1$ and $\Delta T_3$ from (1.21) and (1.22) to be $$\Delta T_2 = \frac{2v_{hh}^* u_{l,3} + \bar{a}^2 - 2\dot{y}_l^*(T_{l,1})u_{l,3}}{2\bar{a}u_{l,3}}, \tag{1.25}$$

wherein $\dot{y}_l^*(T_{l,1})$ follows from (1.15). The switching times can directly be taken from the time intervals:

$$T_{l,i} = T_{l,i-1} + \Delta T_i, i=1,2,3. \tag{1.26}$$

The velocity and acceleration profiles $\dot{y}_l^*$ and $\ddot{y}_l^*$ to be planned can be calculated analytically with the individual switching times. It should be mentioned that the trajectories planned by the switching times frequently are not traversed completely, since before reaching the switching time $T_{l,3}$ a new situation occurs, replanning thereby takes place and new switching times must be calculated. As mentioned already, a new situation occurs by a change in $w_{hh}$, $v_{max}$, $a_{max}$ or $k_l$.

Figure 8:
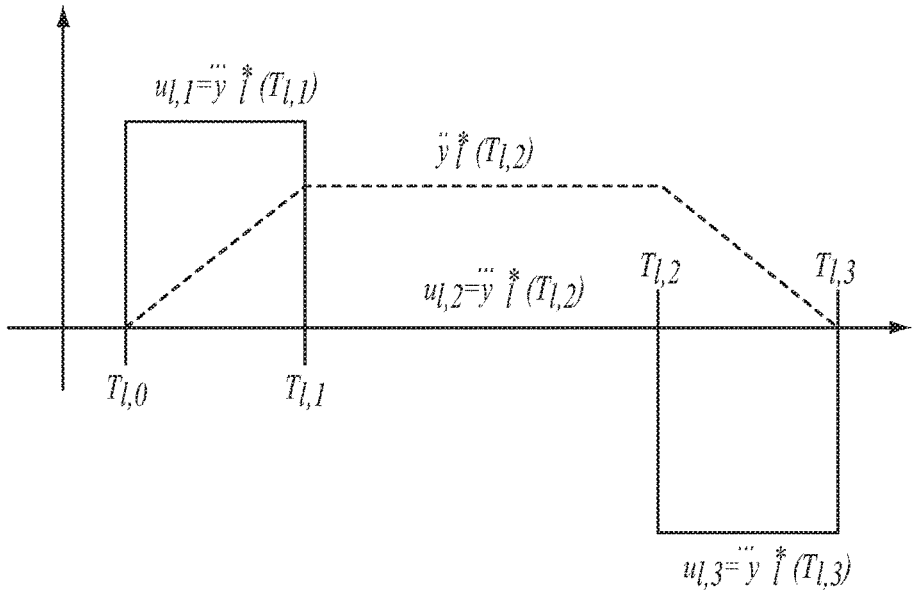
FIG. 8 shows an exemplary jerk profile with associated switching times, from which a trajectory for the position and/or velocity and/or acceleration of the hoisting gear is calculated with reference to the path planning.

FIG. 8 shows a trajectory generated by the presented method by way of example. The course of the trajectories includes both cases which can occur due to (1.24). In the first case, the maximum admissible acceleration is reached at the time t=1 s, followed by a phase with constant acceleration. The second case occurs at the time t=3.5 s. Here, the maximum admissible acceleration is not reached completely due to the hand lever position. The consequence is that the first and the second switching time coincide, and $\Delta T_2=0$ applies. According to FIG. 5, the associated position course is calculated by integration of the velocity curve, wherein the position at system start is initialized by the cable length currently unwound from the hoisting winch.

Actuation Concept for the Hoisting Winch

Figure 9:
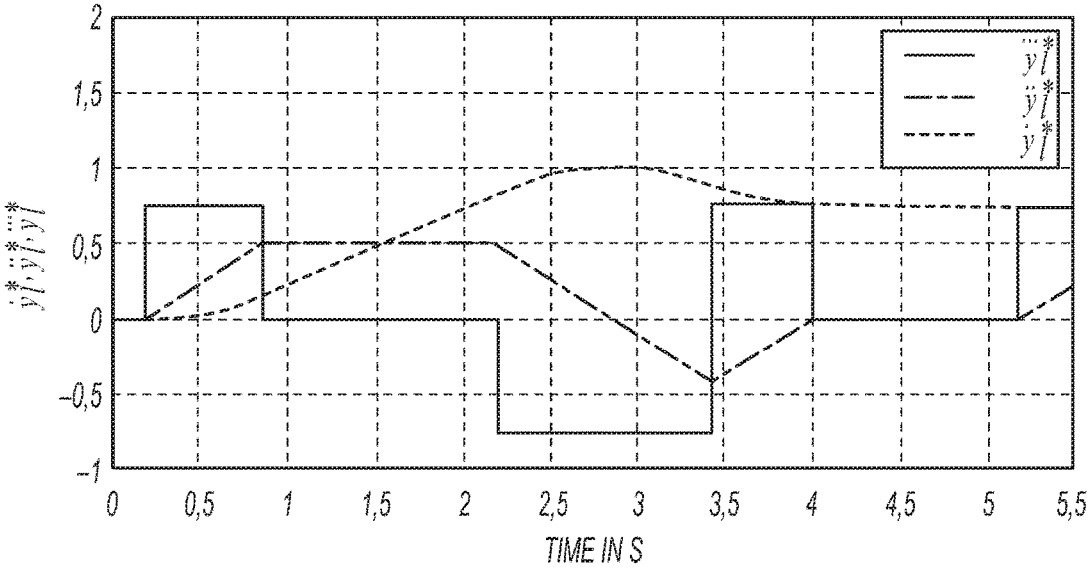
FIG. 9 shows a course of a velocity and acceleration trajectory generated with the jerk addition.

In principle, the actuation includes two different operating modes: the active heave compensation for decoupling the vertical load movement from the ship movement with free-hanging load and the constant tension control for avoiding a slack cable, as soon as the load is deposited on the sea bed. During a deep-sea lift, the heave compensation initially is active. With reference to a detection of the depositing operation, switching to the constant tension control is effected automatically. FIG. 9 illustrates the overall concept with the associated reference and control variables.

Each of the two different operating modes however might also be implemented each without the other operating mode. Furthermore, a constant tension mode as it will be described below can also be used independent of the use of the crane on a ship and independent of an active heave compensation.

Due to the active heave compensation, the hoisting winch should be actuated such that the winch movement compensates the vertical movement of the cable suspension point $z_a^h$ and the crane operator moves the load by the hand lever in the h coordinate system regarded as inertial. To ensure that the actuation has the required predictive behavior for minimizing the compensation error, it is implemented by a pilot control and stabilization part in the form of a structure of two degrees of freedom. The pilot control is calculated from a differential parameterization by the flat output of the winch dynamics and results from the planned trajectories for moving the load $y_l^*$, $\dot{y}_l^*$ and $\ddot{y}_l^*$ as well as the negative trajectories for the compensation movement $-y_a^*$, $-\dot{y}_a^*$ and $-\ddot{y}_a^*$ (cf. FIG. 9). The resulting target trajectories for the system output of the drive dynamics and the winch dynamics are designated with $y_h^*$, $\dot{y}_h^*$ and $\ddot{y}_h^*$. They represent the target position, velocity and acceleration for the winch movement and thereby for the winding and unwinding of the cable.

During the constant tension phase, the cable force at the load $F_{sl}$ is to be controlled to a constant amount, in order to avoid a slack cable. The hand lever therefore is deactivated in this operating mode, and the trajectories planned on the basis of the hand lever signal no longer are added. The actuation of the winch in turn is effected by a structure of two degrees of freedom with pilot control and stabilization part.

The exact load position $z_l$ and the cable force at the load $F_{sl}$ are not available as measured quantities for the control, since due to the long cable lengths and great depths the crane hook is not equipped with a sensor unit. Furthermore, no information exists on the kind and shape of the suspended load. Therefore, the individual load-specific parameters such as load mass $m_l$, coefficient of the hydrodynamic increase in mass $C_a$, coefficient of resistance $C_d$ and immersed volume $\nabla_l$, are not known in general, whereby a reliable estimation of the load position is almost impossible in practice.

Thus, merely the unwound cable length $l_s$ and the associated velocity $i_s$ as well as the force at the cable suspension point $F_c$ are available as measured quantities for the control. The length $l_s$ is obtained indirectly from the winch angle $\phi_h$ measured with an incremental encoder and the winch radius $r_h(j_l)$ dependent on the winding layer $j_l$. The associated cable velocity $i_s$ can be calculated by numerical differentiation with suitable low-pass filtering. The cable force $F_c$ applied to the cable suspension point is detected by a force measuring pin.

2.1 Actuation for the Active Heave Compensation

Figure 10:
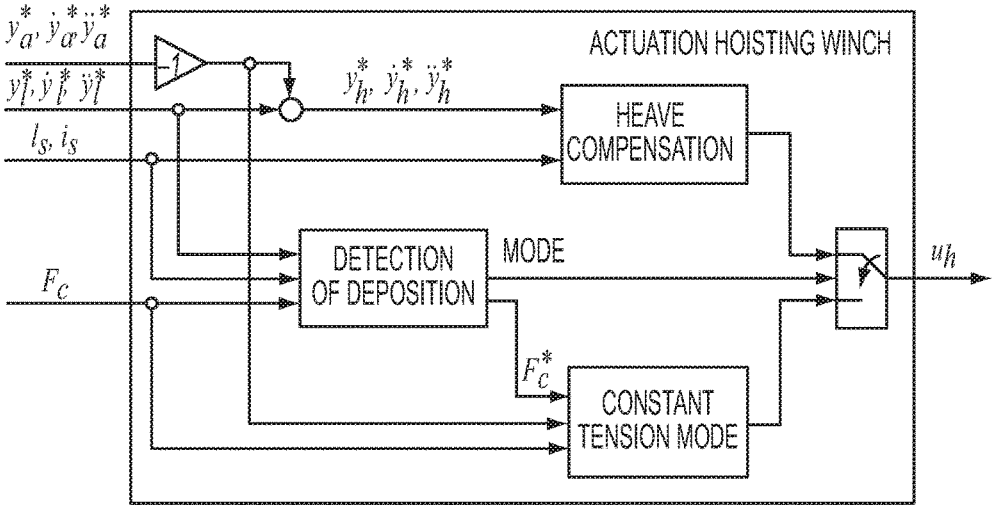
FIG. 10 shows an overview of the actuation concept with an active heave compensation and a target force mode, here referred to as constant tension mode.

FIG. 10 illustrates the actuation of the hoisting winch for the active heave compensation with a block circuit diagram in the frequency range. As can be seen, there is only effected a feedback of the cable length and velocity $y_h=l_s$ and $\dot{y}_h=i_s$ from the partial system of the drive $G_h(s)$. As a result, the compensation of the vertical movement of the cable suspension point $Z_a^h(s)$ acting on the cable system $G_{s,z}(s)$ as input interference takes place purely as pilot control; cable and load dynamics are neglected. Due to a non-complete compensation of the input interference or a winch movement, the inherent cable dynamics is incited, but in practice it can be assumed that the resulting load movement is greatly attenuated in water and decays very fast.

The transfer function of the drive system from the correcting variable $U_h(s)$ to the unwound cable length $Y_h(s)$ can be approximated as $IT_1$ system and results in $$G_h(s) = \frac{Y_h(s)}{U_h(s)} = \frac{K_h r_h(j_l)}{T_h s^2 + s} \tag{2.1}$$

with the winch radius $r_h(j_l)$. Since the system output $Y_h(s)$ at the same time represents a flat output, the inverting pilot control F(s) will be $$F(s) = \frac{U_{ff}(s)}{Y_h^*(s)} = \frac{1}{G_h(s)} = \frac{T_h}{K_h r_h(j_l)} s^2 + \frac{1}{K_h r_h(j_l)} s \tag{2.2}$$

and can be written in the time domain in the form of a differential parameterization as $$u_{ff}(t) = \frac{T_h}{K_h r_h(j_l)} \ddot{y}_h^*(t) + \frac{1}{K_h r_h(j_l)} \dot{y}_h^*(t) \tag{2.3}$$

(2.3) shows that the reference trajectory for the pilot control must be steadily differentiable at least two times.

The transfer function of the closed circuit, consisting of the stabilization $K_a(s)$ and the winch system $G_h(s)$, can be taken from FIG. 10 to be $$G_{AHC}(s) = \frac{K_a(s)G_h(s)}{1 + K_a(s)G_h(s)} \tag{2.4}$$

By neglecting the compensation movement $Y_a^*(s)$, the reference variable $Y_h^*(s)$ can be approximated as ramp-shaped signal with a constant or stationary hand lever deflection, as in such a case a constant target velocity $v_{hh}^*$ exists. To avoid a stationary control deviation in such reference variable, the open chain $K_a(s)G_h(s)$ therefore must show a $I_2$ behavior [9]. This can be achieved for example by a PID controller with $$K_a(s) = \frac{T_h}{K_h r_h(j_l)} \left( \frac{\kappa_{AHC,0}}{s} + \kappa_{AHC,1} + \kappa_{AHC,2} s \right), \kappa_{AHC,i} > 0 \tag{2.5}$$

Hence it follows for the closed circuit:

$$G_{AHC}(s) = \frac{\kappa_{AHC,0} + \kappa_{AHC,1} s + \kappa_{AHC,2} s^2}{s^3 + \left( \frac{1}{T_h} + \kappa_{AHC,2} \right) s^2 + \kappa_{AHC,1} s + \kappa_{AHC,0}}, \tag{2.6}$$

wherein the exact values of $\kappa_{AHC,i}$ are chosen in dependence on the respective time constant $T_h$.

Detection of the Depositing Operation

As soon as the load hits the sea bed, switching from the active heave compensation into the constant tension control should be effected. For this purpose, a detection of the depositing operation is necessary (cf. FIG. 9). For the same and the subsequent constant tension control, the cable is approximated as simple spring-mass element. Thus, the force acting at the cable suspension point approximately is calculated as follows $$F_c = k_c \Delta l_c, \tag{2.7}$$

wherein $k_c$ and $\Delta l_c$ designate the spring constant equivalent to the elasticity of the cable and the deflection of the spring. For the latter, it applies:

$$\Delta l_c = \int_0^l \varepsilon_s(\bar{s}, t)\, d\bar{s} = \bar{z}_{s,stat}(1) - \bar{z}_{s,stat}(0) - l_s = \frac{g l_s}{E_s A_s} \left( m_e + \frac{1}{2} \mu_s l_s \right). \tag{2.8}$$

The equivalent spring constant $k_c$ can be determined from the following stationary observation. For a spring loaded with the mass $m_f$ it applies in the stationary case:

$$k_c \Delta l_c = m_f g. \tag{2.9}$$

A transformation of (2.8) results in $$\frac{E_s A_s}{l_s} \Delta l_c = \left( m_e + \frac{1}{2} \mu_s l_s \right) g. \tag{2.10}$$

With reference to a coefficient comparison between (2.9) and (2.10) the equivalent spring constant can be read as $$k_c = \frac{E_s A_s}{l_s} \tag{2.11}$$

In (2.9) it can also be seen that the deflection of the spring $\Delta l_c$ in the stationary case is influenced by the effective load mass $m_e$ and half the cable mass $$\frac{1}{2}\mu_s l_s.$$

This is due to the fact that in a spring the suspended mass $m_f$ is assumed to be concentrated in one point. The cable mass, however, is uniformly distributed along the cable length and therefore does not fully load the spring. Nevertheless, the full weight force of the cable $\mu_s l_s g$ is included in the force measurement at the cable suspension point.

With this approximation of the cable system, conditions for the detection of the depositing operation on the sea bed now can be derived. At rest, the force acting on the cable suspension point is composed of the weight force of the unwound cable $\mu_s l_s g$ and the effective weight force of the load mass $m_e g$. Therefore, the measured force $F_c$ with a load located on the sea bed approximately is $$F_c=(m_e+\mu_s l_s)g+\Delta F_c \tag{2.12}$$

with $$\Delta F_c=-k_c\Delta l_s, \tag{2.13}$$

wherein $\Delta l_s$ designates the cable unwound after reaching the sea bed. From (2.13) it follows that $\Delta l_s$ is proportional to the change of the measured force, since the load position is constant after reaching the ground. With reference to (2.12) and (2.13) the following conditions now can be derived for a detection, which must be satisfied at the same time:

The decrease of the negative spring force must be smaller than a threshold value:

$$\Delta F_c<\Delta\hat{F}_c. \tag{2.14}$$

The time derivative of the spring force must be smaller than a threshold value:

$$\dot{F}_c<\dot{\hat{F}}_c. \tag{2.15}$$

The crane operator must lower the load. This condition is checked with reference to the trajectory planned with the hand lever signal:

$$\dot{y}_l^*\geq 0. \tag{2.16}$$

To avoid a wrong detection on immersion into the water, a minimum cable length is unwound as:

$$l_s>l_{s,min}. \tag{2.17}$$

The decrease of the negative spring force $\Delta F_c$ each is calculated with respect to the last high point $\overline{F}_c$ in the measured force signal $F_c$. To suppress measurement noise and high-frequency interferences, the force signal is preprocessed by a corresponding low-pass filter.

Since the conditions (2.14) and (2.15) must be satisfied at the same time, a wrong detection as a result of a dynamic inherent cable oscillation is excluded: As a result of the dynamic inherent cable oscillation, the force signal $F_c$ oscillates, whereby the change of the spring force $\Delta F_c$ with respect to the last high point $\overline{F}_c$ and the time derivative of the spring force $\dot{F}_c$ have a shifted phase. Consequently, with a suitable choice of the threshold values $\Delta\hat{F}_c$ and $\dot{\hat{F}}_c$ in the case of a dynamic inherent cable oscillation, both conditions cannot be satisfied at the same time. For this purpose, the static part of the cable force must drop, as is the case on immersion into the water or on deposition on the sea bed. A wrong detection on immersion into the water, however, is prevented by condition (2.17).

The threshold value for the change of the spring force is calculated in dependence on the last high point in the measured force signal as follows:

$$\Delta\hat{F}_c=\min\{-\chi_1\overline{F}_c,\Delta\hat{F}_{c,max}\}. \tag{2.18}$$

wherein $\chi_1<1$ and the maximum value $\Delta\hat{F}_{c,max}$ were determined experimentally. The threshold value for the derivative of the force signal $\dot{\hat{F}}_c$ can be estimated from the time derivative of (2.7) and the maximum admissible hand lever velocity $k_l v_{max}$ as follows $$\dot{\hat{F}}_c=\min\{-\chi_2 k_c k_l v_{max},\dot{\hat{F}}_{c,max}\} \tag{2.19}$$

The two parameters $\chi_2<1$ and $\dot{\hat{F}}_{c,max}$ likewise were determined experimentally.

Since in the constant tension control a force control is applied instead of the position control, a target force $F_c^*$ is specified as reference variable in dependence on the sum of all static forces $F_{l,stat}$ acting on the load. For this purpose $F_{l,stat}$ is calculated in the phase of the heave compensation in consideration of the known cable mass $\mu_s l_s$:

$$F_{l,stat}=F_{c,stat}-\mu_s l_s g. \tag{2.20}$$

$F_{c,stat}$ designates the static force component of the measured force at the cable suspension point $F_c$. It originates from a corresponding low-pass filtering of the measured force signal. The group delay obtained on filtering is no problem, as merely the static force component is of interest and a time delay has no significant influence thereon. From the sum of all static forces acting on the load, the target force is derived taking into account the weight force of the cable additionally acting on the cable suspension point, as follows:

$$F_c^*=p_s F_{l,stat}+\mu_s l_s g. \tag{2.21}$$

wherein the resulting tension in the cable is specified by the crane operator with $0<p_s<1$. To avoid a setpoint jump in the reference variable, a ramp-shaped transition from the force currently measured on detection to the actual target force $F_c^*$ is effected after a detection of the depositing operation.

For picking up the load from the sea bed, the crane operator manually performs the change from the constant tension mode into the active heave compensation with free-hanging load.

2.3 Actuation for the Constant Tension Mode

Figure 11:
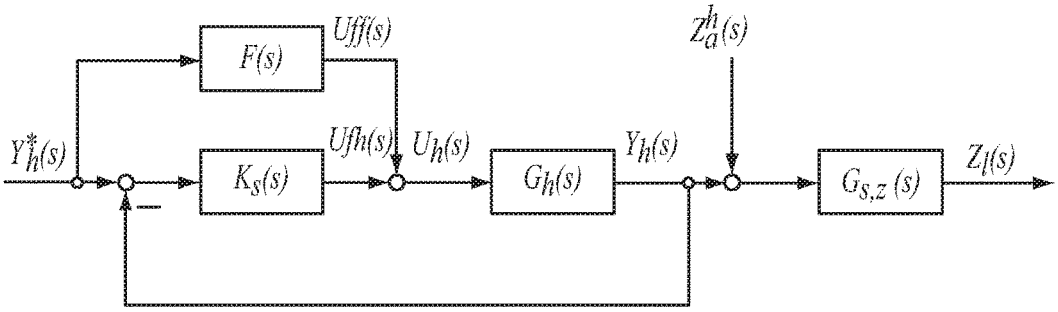
FIG. 11 shows a block circuit diagram of the actuation for the active heave compensation.
Figure 12:
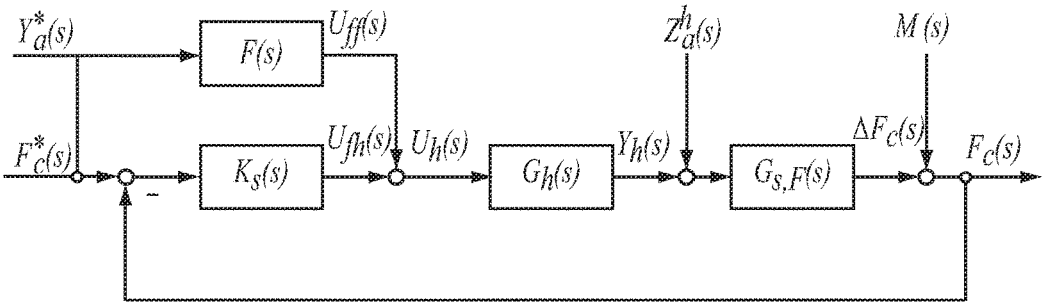
FIG. 12 shows a block circuit diagram of the actuation for the target force mode.

FIG. 11 shows the implemented actuation of the hoisting winch in the constant tension mode in a block circuit diagram in the frequency range. In contrast to the control structure illustrated in FIG. 10, the output of the cable system $F_c(s)$, i.e. the force measured at the cable suspension point, here is fed back instead of the output of the winch system $Y_h(s)$. According to (2.12), the measured force $F_c(s)$ is composed of the change in force $\Delta F_c(s)$ and the static weight force $m_e g+\mu_s l_s g$, which in the Figure is designated with M(s). For the actual control, the cable system in turn is approximated as spring-mass system.

The pilot control F(s) of the structure of two degrees of freedom is identical with the one for the active heave compensation and given by (2.2) and (2.3), respectively. In the constant tension mode, however, the hand lever signal is not added, which is why the reference trajectory only consists of the negative target velocity and acceleration $-\dot{y}_a^*$ and $-\ddot{y}_a^*$ for the compensation movement. The pilot control part initially in turn compensates the vertical movement of the cable suspension point $Z_a^h(s)$. However, a direct stabilization of the winch position is not effected by a feedback of $Y_h(s)$. This is effected indirectly by the feedback of the measured force signal.

The measured output $F_c(s)$ is obtained from FIG. 11 as follows $$F_c(s) = G_{CT,1}(s)\underbrace{[Y_a^*(s)F(s)G_h(s) + Z_a^h(s)]}_{E_a(s)} + G_{CT,2}(s)F_c^*(s) \tag{2.22}$$

with the two transfer functions $$G_{CT,1}(s) = \frac{G_{s,F}(s)}{1 + K_s(s)G_h(s)G_{s,F}(s)}, \tag{2.23}$$

$$G_{CT,2}(s) = \frac{K_s(s)G_h(s)G_{s,F}(s)}{1 + K_s(s)G_h(s)G_{s,F}(s)}, \tag{2.24}$$

wherein the transfer function of the cable system for a load standing on the ground follows from (2.12):

$$G_{s,F}(s) = -k_c. \tag{2.25}$$

As can be taken from (2.22), the compensation error $E_a(s)$ is corrected by a stable transfer function $G_{CT,1}(s)$ and the winch position is stabilized indirectly. In this case, too, the requirement of the controller $K_s(s)$ results from the expected reference signal $F_c^*(s)$, which after a transition phase is given by the constant target force $F_c^*$ from (2.21). To avoid a stationary control deviation with such constant reference variable, the open chain $K_s(s)G_h(s)G_{s,F}(s)$ must have an I behavior. Since the transfer function of the winch $G_h(s)$ already implicitly has such behavior, this requirement can be realized with a P feedback; thus, it applies:

$$K_s(s) = \frac{T_h}{K_h r_h(j_t)}\kappa_{CT},\ \kappa_{CT} > 0. \tag{2.6}$$

The invention claimed is:

1. A crane controller for a crane which includes a hoisting gear for lifting a load hanging on a cable, comprising:

an active heave compensation which by actuating the hoisting gear at least partly compensates a movement of a cable suspension point and/or a load deposition point due to a heave; and an operator control which actuates the hoisting gear with reference to specifications of an operator, wherein a division of at least one kinematically constrained quantity of the hoisting gear is adjustable between the heave compensation and the operator control, wherein the division of the at least one kinematically constrained quantity is effected via at least one weighting factor, via which a maximum available power and/or velocity and/or acceleration of the hoisting gear is split up between the heave compensation and the operator control.

2. The crane controller according to claim 1, wherein the division of the at least one kinematically constrained quantity of the hoisting gear comprises a division of the maximum available power and/or maximum available velocity and/or maximum available acceleration of the hoisting gear.

3. The crane controller according to claim 1, wherein the division is steplessly adjustable at least over a partial region and/or wherein the heave compensation is switched off by assigning an entire at least one kinematically constrained quantity to the operator control.

4. A crane controller for a crane which includes a hoisting gear for lifting a load hanging on a cable, comprising:

an active heave compensation which by actuating the hoisting gear at least partly compensates movement of a cable suspension point and/or a load deposition point due to heave; and an operator control which actuates the hoisting gear with reference to specifications of an operator, wherein the controller includes two separate path planning modules via which trajectories for the heave compensation and for the operator control are calculated separate from each other, wherein the trajectories specified by the two separate path planning modules are added up and serve as setpoint values for control and/or regulation of the hoisting gear, wherein the control of the hoisting gear feeds back measured values to a position and/or velocity of a hoisting winch of the hoisting gear and/or takes account of dynamics of a drive of the hoisting winch.

5. The crane controller according to claim 4, wherein the heave compensation includes an optimization function which calculates a trajectory with reference to a predicted movement of the cable suspension point and/or the load deposition point and takes into account at least one kinematically constrained quantity available for the heave compensation, wherein the operator control calculates a trajectory with reference to specifications of the operator and takes into account at least one kinematically constrained quantity available for the operator control.

6. The crane controller according to claim 5, wherein a division of the at least one kinematically constrained quantity is changed during a lifting operation.

7. The crane controller according to claim 4, further comprising a calculation function which calculates a currently available at least one kinematically constrained quantity, wherein the calculation function takes account of a length of unwound cable and/or a cable force and/or a power available for driving the hoisting gear.

8. The crane controller according to claim 6, wherein the optimization function of the heave compensation initially includes a change in the division of the at least one kinematically constrained quantity of the hoisting gear and/or a change of an available at least one kinematically constrained quantity of the hoisting gear during lifting only at an end of a prediction horizon and then pushes the at least one kinematically constrained quantity to a beginning with progressing time.

9. The crane controller according to claim 8, wherein the optimization function of the heave compensation determines a target trajectory which is included in the control of the hoisting gear, wherein optimization can be effected at each time step on the basis of an updated prediction of movement of a load lifting point.

10. The crane controller according to claim 8, wherein the optimization function of the heave compensation determines a target trajectory which is included in the control of the hoisting gear, wherein the optimization function works with a greater scan time than the control.

11. The crane controller according to claim 8, wherein the optimization function of the heave compensation determines a target trajectory which is included in the control of the hoisting gear, wherein the optimization function makes use of an emergency trajectory planning when no valid solution is found.

12. The crane controller according to claim 8, wherein the operator control calculates a velocity desired by the operator with reference to a signal specified by an operator through an input device.

13. A crane controller for a crane which includes a hoisting gear for lifting a load hanging on a cable, comprising:

an active heave compensation which by actuating the hoisting gear at least partly compensates movement of a cable suspension point and/or a load deposition point due to heave; and an operator control which actuates the hoisting gear with reference to specifications of an operator, wherein the controller includes two separate path planning modules via which trajectories for the heave compensation and for the operator control are calculated separate from each other, wherein the heave compensation includes an optimization function which calculates a trajectory with reference to a predicted movement of the cable suspension point and/or the load deposition point and takes into account at least one kinematically constrained quantity available for the heave compensation, wherein the operator control calculates a trajectory with reference to specifications of the operator and takes into account at least one kinematically constrained quantity available for the operator control, wherein a division of the at least one kinematically constrained quantity is changed during a lifting operation, wherein the optimization function of the heave compensation initially includes a change in the division of the at least one kinematically constrained quantity of the hoisting gear and/or a change of an available at least one kinematically constrained quantity of the hoisting gear during lifting only at an end of a prediction horizon and then pushes the at least one kinematically constrained quantity to a beginning with progressing time, wherein the operator control calculates a velocity desired by the operator with reference to a signal specified by an operator through an input device, and wherein path planning of the operator control generates the trajectory by integration of a maximum admissible positive jerk, until a maximum acceleration is achieved, and thereupon is achieved by integration of the maximum acceleration, until the desired velocity can be achieved by adding a maximum negative jerk.

* * * * *